United States Patent [19]

Valentine et al.

[11] Patent Number: 4,659,076

[45] Date of Patent: Apr. 21, 1987

[54] CONSTRUCTION OF HANDBAR FOR RUNNERS

[75] Inventors: Peter Z. Valentine, 55 Blanche St., Cambridge, Mass. 02139; Franco Vitaliano, Boston; Ivor S. Smith, Brookline, both of Mass.

[73] Assignee: Peter Z. Valentine, Cambridge, Mass.

[21] Appl. No.: 609,648

[22] Filed: May 14, 1984

[51] Int. Cl.[4] ..... A63B 23/00

[52] U.S. Cl. ..... 272/93; 272/67; 272/DIG. 9

[58] Field of Search ..... 272/67, 68, 93, 143; 132/76.4; 128/62 R, 907; D21/100

[56] References Cited

U.S. PATENT DOCUMENTS

| | | | |
|---|---|---|---|
| D. 33,270 | 9/1900 | Avery | 273/341 |
| 1,387,946 | 8/1921 | Rutherford et al. | 273/341 |
| 3,111,322 | 11/1963 | English | 272/68 |
| 3,330,558 | 7/1967 | Simons | 272/68 |
| 3,411,498 | 11/1968 | Reiter | 128/62 R |
| 3,557,776 | 1/1971 | Boots . | |
| 3,750,654 | 8/1973 | Shiu . | |
| 4,251,071 | 2/1981 | Norton | 272/68 X |
| 4,278,248 | 7/1981 | Kifferstein . | |

FOREIGN PATENT DOCUMENTS

| | | | |
|---|---|---|---|
| 0145013 | 3/1936 | Australia | 128/62 R |

*Primary Examiner*—Robert A. Hafer
*Assistant Examiner*—Kathleen J. D'Arrigo
*Attorney, Agent, or Firm*—Pennie & Edmonds

[57] ABSTRACT

A handbar characterized by an elongated, generally polygonal shaped article including a neck portion in the region of one end, and a tapered length extending from the central region of the article toward the other end. The article preferably is ractangular. The corner edges along their length and a roughened thumb placement area on one surface near the tapered end provide tactile stimulation, while the overall shape of the articles provides visual stimulation in an attempt to increase balance, relaxation and safety during recreational and competitive running.

16 Claims, 8 Drawing Figures

CONSTRUCTION OF HANDBAR FOR RUNNERS

DESCRIPTION

1. Technical Field

The invention is in a handbar which may be used in exercising, to stablize hand movement. Hand stabilization has been found to result from visual and tactile stimulation, and the result of a stabilization is an increased balance, relaxation and safety during exercise, such as running.

2. Background of the Invention

In recent years, evidence has been accumulated to support the conclusion that exercise properly carried out promotes health, well-being and vitality in our society. Because of its simplicity, the exercise of running to increase muscle activity and cardiac output has grown in popularity.

As a form of exercise, running is not without its problems. Referring to psychological problems, the runner may be subject to boredom and distraction. Referring to physical problems, the runner may subject himself or herself to over-exertion and the runner may suffer from accident, injury to the back, knees and ankles, conditions of plantar fasciitis, Achilles tendinitis and shin splints, all of which are especially likely to afflict the novice, or the occasional or ill-prepared participant.

One of the major difficulties acknowledged by runners is an imbalance in the use of their hands. Experienced runners concentrate on controlling the use of their hands and arms to increase efficiency and performance, and to avoid distraction and a reduction in concentration which may result from a lack of control. A lack of control of the hands and arms may also manifest itself in a decrease in awareness both of physical change within the runner and of obstacles along the path. The lack of control, also, disrupts a smooth respiratory cycle, and has the effect to increase tension and the likelihood of an inappropriate reaction to physical and mental stress. All or some of these reactions will set the stage for injury.

The late Australian running coach Percy Cerutty has been attributed with the recognition that natural running begins in the fingers, and that perceptions are transferred to the legs and feet. A control of the hands, then, would appear to impart control to all body systems.

During 1947, the American neurosurgeon Wilder Penfield demonstrated by electrical stimulation of the brain of the human species that the hand and thumb, as compared to other regions of the body, are represented on the cerebral cortex by an inordinate amount of sensory and motor innervation (see FIG. 1, representing in diagram form a cross section of the cortex to show the sensory areas for the skin of various parts of the body and motor areas for movement—from Penfield and Rasmussen, 1950). All cerebral cells are intimately connected and maintain their activity constantly. Thus, it is considered probable that a lack of control of the hands, reflected in such a large area of the cerebral cortex, should spread its adverse effects to other body areas and system. Tension, via the hypothalamus and autonomic nervous systems, produces inappropriate hormonal responses throughout the body which are costly in terms of energy. These tensions, also, decrease regional blood flow to the heart and skeletal muscles.

In the ancient Chinese art or method of healing, the hand is a major locus of acupuncture points. The Hoku point, the location between the thumb and first finger, is stimulated in conditions affecting the chest, shoulders, neck and jaw, as well as in lumbar strain. This would seem to indicate empirically that, at least by the theory of energy flow, the thumb-hand relationship is important in relieving tension in the upper body.

The shape of an object is known to impart a sense of strength and stability. A polygonal shape, such as a rectangular or square or other closed-sided shape is considered stable, whereas a circular shape is considered unstable. Thus, an object may be sensed to be less stable as the number of sides approach a circular cross section. A pointed end gives direction. A smooth surface is calming, while a rough surface is stimulating. The thenar eminence (thumb pad) is endowed with more sensory endings than any skin area excepting the finger tips and the lips, and thus is especially sensitive to changes in shape and texture. The inherent beauty of wood has a calming effect, yet it possesses a feel of strength and comfort.

Prior patents which have general relevance of the invention include U.S. Pat. Nos. 3,556,776 to E. R. Boots et al and 4,278,248 to H. P. Kifferstein. According to Boots et al a hand-holdable device, referred to as a "pacifier", is characterized as an elongated body, shaped to conform to the hand as the body is gripped. One end of the body is wider than the other end, and the body includes a groove within which the thumb is able to engage. The groove is located along a top, generally flat surface of the body and extends from the wider end toward the mid-region of the body. The body, otherwise, is rounded from side-to-side to conform to the hand, and the narrower end which comprises a handle portion conforms to the grip by a plurality of spaced finger receiving grooves. The Boots et al patent suggests that the body is intended to afford a pleasurable sensation, a calming effect and it provides a release for nervous energy to contribute to a general sense of well-being.

The Kifferstein patent relates to a device for use particularly by an aggresive walker for purposes of achieving proper motion-timing. The device includes structure to provide a rythmic indication of a synchronism between arm and leg motion. The Kifferstein patent also suggests a use of the device generally characterized by a tubular body, preferably in the form of a pair of devices to be gripped, one in each hand, as an exerciser while walking. An audible synchronizing sound is emitted by a weighted mass propelled within the body from one end to the other.

One further patent which is known is U.S. Pat. No. 3,750,654 to D. K. Shin. The Shin patent relates to a physiotherapeutic device in the form of a roller and a method of physical stimulation through use.

SUMMARY OF THE INVENTION

A handbar is disclosed. The handbar is adapted for use during exercise, which may be competitive or recreational running, to stabilize hand movement through both visual and tactile stimulation and increase balance and relaxation during running. Attendant to the benefit of an increase in balance and relaxation is the increase in safety from injury to the runner during exercise.

The handbar may be formed of substantially any material, such as wood, plastic and the like, characterized by lightness of weight. In a preferred embodiment, the handbar may be formed of wood. The invention, further, lends itself to a wide choice of woods, and the handbar may be of laminated construction. It is contemplated to incorporate into the handbar an insert of a form which would allow the incorporation of a mechanism to assist running. To this end, the mechanism, supported by an insert in a cut-out or indentation in the handbar itself, may assist in health and/or exercise measurement, and it may have a capability of providing entertainment, protection and the coordination of running with other activity.

The handbar has a first and second end, and an elongated body connecting the ends. The handbar, along its length, preferably is of polygonal outline (referring to a cross section taken perpendicular to the axis of the handbar). Within this broad context, the handbar may include as many or more than twelve sides, and as few as three or four sides. The sides are joined by edges which provide a tactile delineation of each side surface of the polygonal outline. The tactile delineation is more acute if the number of sides is somewhat limited. A handbar having four sides, in the outline of a square, has provided good results.

The handbar, additionally, includes an area of teardrop shape conforming generally to the size of a thumbprint located within at least one of the sides in an off center location along its length. The handbar may be tapered along one end toward a tip, and the area may be located near the region of taper. The outline of the handbar at the tip will be concentric to the outline of the body adjacent to the taper. The other end of the handbar corresponds to the shape of the central region and there is an indented length or neck connecting the central region to the other end. The indented length is formed by surfaces which taper toward and intersect at a location of maximum indentation. A cross section through the handbar at the location of maximum indentation will be concentric and substantially coextensive in cross section with that of the tip. A bore may be formed through the other end to receive a thong or some other tie if the handbar is to be stored, or to be placed around the wrist during running or walking.

The area, as discussed area preferably includes a surface which is characterized by roughening in the form of a multiplicity of indentations or dimples and further including a plurality of holes both within the area and around the perimeter of the area. The area may be termed a "roughened area". As a further source of tactile stimulation, a plurality of notches may be formed along an edge within the central region. The distressed surface, holes and notches may be present on one or more surfaces, or edges within the central region.

The handbar, by means of its shape, and through physical contact as well as visual and mental association, imparts to the holder certain sensations or feelings beneficial to the efficiency, enjoyment and safety of running. Due to the possibility of peculiarity in human preference, handbar shape modifications within the stated linear forms, such as to include a gradually narrowing end, a body with a gradual concavity along the respective sides, or an undulation formed by a series of concavities, and a larger, more compact opposite end, for example.

BEST MODE FOR CARRYING OUT THE INVENTION

The handbar 10 of the invention may be used during competitive and recreational running in an attempt to increase balance, relaxation and safety. These goals are believed attainable through the stabilization of hand movement which follows from the overall shape of the handbar and by both visual and tactile stimulation.

It is conceptualized that the shape of the handbar, to be particularly described below, serves through physical contact and mental and visual association as a source to give or impart to the holder certain sensations or feelings beneficial to the efficiency, enjoyment and safety in running as the fingers of the hand move into and along regions of the handbar.

Without any intent to limit the invention, the breadth of which is recited in the claims, but to provide a full description of what is a preferred embodiment thereof, handbar 10 is characterized by an elongated length and a polygonal cross section. The handbar, more particularly, may have a length of about $6\frac{1}{2}$ to about 8 inches, and a width proportionally arranged to accommodate a difference in size of the hand of the user. Typically, the handbar may be about $7\frac{3}{4}$ inches in length and each side may be about $\frac{3}{4}$ inch in width. A square cross section has been found to be a particularly pleasing cross sectional contour.

Running is considered a physical sport, and it is believed that running is made easier by focusing the mind and body action on lighter weight stimuli which blocks out the preoccupation of the mind on the heavy parts of the body, such as the legs, arms, chest, and so forth which tend to make running heavy. The handbar which overall is light in weight, of 2 to 4 ounces in weight, held in the light weight extremities of the hand and fingers enables the mind and body through touch and sight to feel uplifted, stabilized and strengthened. These uplifting and strengthening sensations assist in activating a more mental rather than physical form of running.

Figure 1:
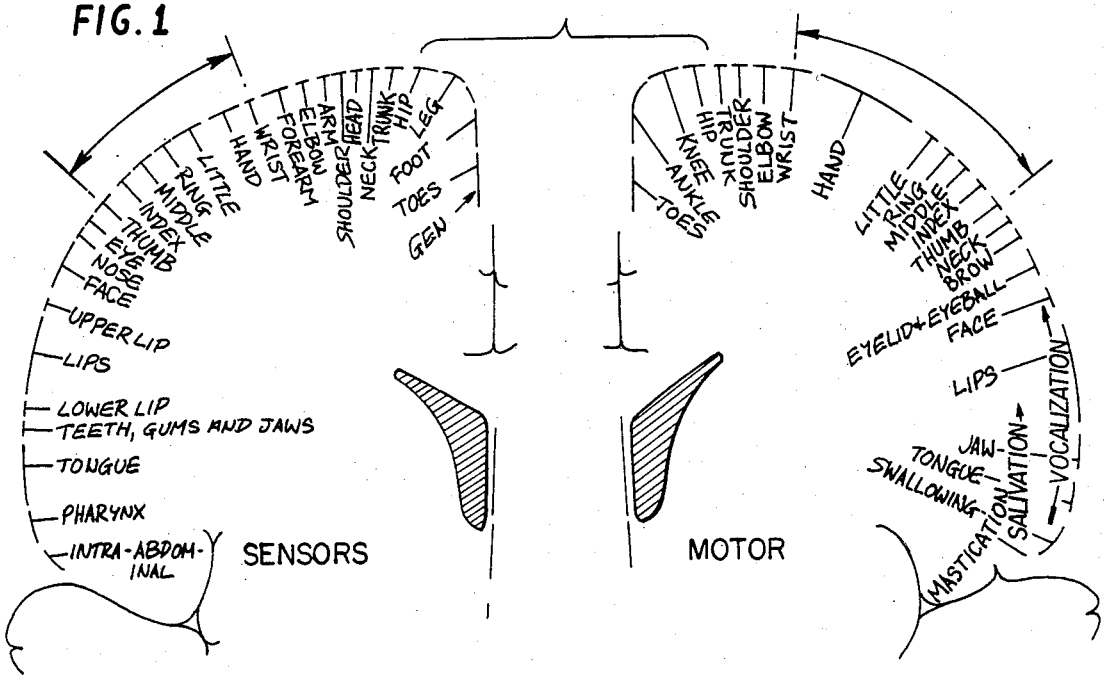
FIG. 1 is a diagram of the cross sections of the cerebral cortex.
Figure 3:
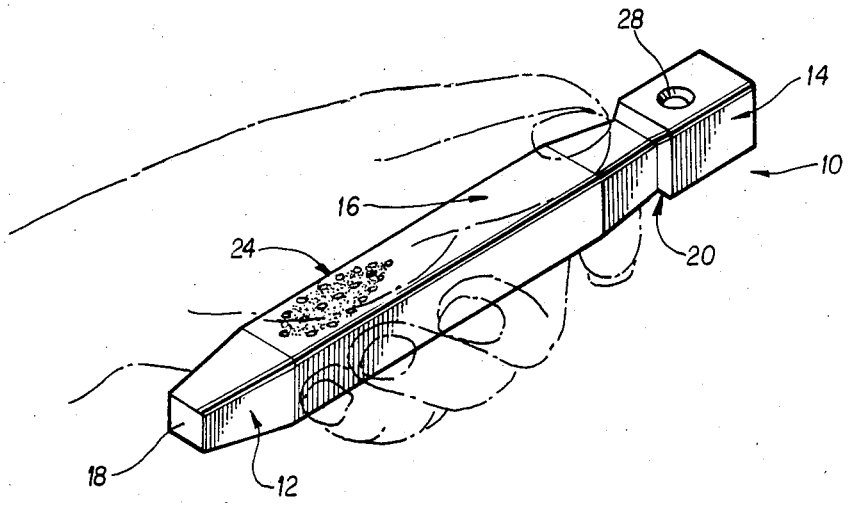
FIG. 3 is a view like FIG. 2 with the blunt end of the handbar forward.

Handbar 10 has a first, pointed end 12 and a second end 14 which extend from a central region 16. During use, the handbar 10 is held with one or the other end located in the forward direction (see FIGS. 2 and 3). The first or pointed end 12 is formed by tapering each of the surfaces toward a tip 18. Preferably the angles of taper are equal and the tapered length will provide a gradual transition from the width handbar within the central region toward the tip.

A neck portion characterized as an indented length 20 connects the second end 14 and central region 16. The neck portion has a minimum dimension at the location of maximum indentation about equal to that of tip 18 and is formed by a plurality of converging, intersecting surfaces which taper from the central region and from the second end. Preferably, each surface will extend along substantially equal angles of taper.

The handbar 10 held with either the first or second end located in the forward position provides a feeling of stability during the running gait. If the first, narrowed end is located in the forward and upward position, the handbar by virtue of the lighter forward mass and the visual stimulus for a sense of lightweightedness provides an uplifting feeling which acts to counteract sensations of heaviness of the body resulting from fatigue while running. On the other hand, if the second, or blunt end of the handbar having the greater mass is located in the forward and upward position, the runner, again by the visual stimulus, is inspired with a feeling of power. The more concentrated end inspires the runner to use more force to push forward. overall, however, the handbar through its shape provides a stabilization of hand movement by tactile and visual stimulation to increase balance, relaxation and safety during running.

The handbar 10, throughout its length, is a flat sided article including a plurality (in the preferred form of the invention, four) of either pointed (or sharp), curved or flattened edges 22. These edges, and it may be preferred to somewhat round the edges, provide a feeling of specific placement of the palm and fingers by virtue, of the ability of the fingers to move from one flat surface to the next over a clearly divided edge. The dividing feeling of the long side edges increases the sense of exact position and movement in the fingers, and this increased sense is transmitted to the entire body. While the handbar, discussed previously as polygonal in cross section, may include many sides, the square cross sectional contour in addition to its pleasing appearance accentuates the sense of position and finger control which is less distinct when the articles are circular or many sided cross section.

The second end 14 of handbar 10 also is square in shape. More particularly, the ends 12, 14 and central region 16 are of square cross section. This shape visually stimulates a sense of stability and balance through the tactile and visual senses and by mental association with many familiar forms that inure in people a sense of stability in everyday life.

A roughened, thumb placement area 24 is located within the central region, toward the first end 12 of handbar 10. The placement area includes a distressed or slightly dimpled surface and a plurality of holes 26 located both within the confines of the placement area as well as along the periphery of the area. The overall shape of the placement area may be likened to that of a tear drop which extends toward the second end 14 of the handbar. The layout of the several holes within the distressed or slightly dimpled surface, while not critical, is such to provide a subtle positive difference. Overall, when the roughened, thumb placement area is rubbed during a period when the runner feels dulled by strain, fatigue, numbing of muscles, or excessive perspiration, the rubbing produces a feeling of mental association that the dullness is being rubbed away and there is a resharpening of the runner's concentration. Various textures may be used, and the thumb placement area may be provided on more than one of the sides within the central region, or within other regions of the handbar for that matter.

Figure 2:
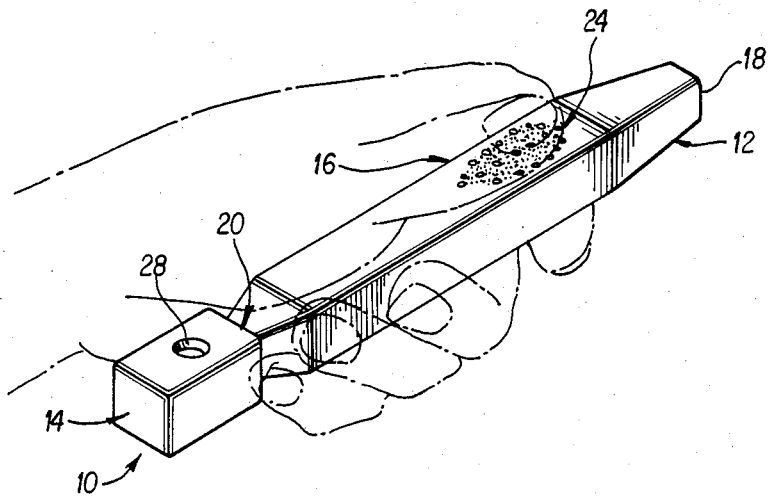
FIG. 2 is a perspective view of the handbar for runners, held with the pointed end forward.
Figure 4:
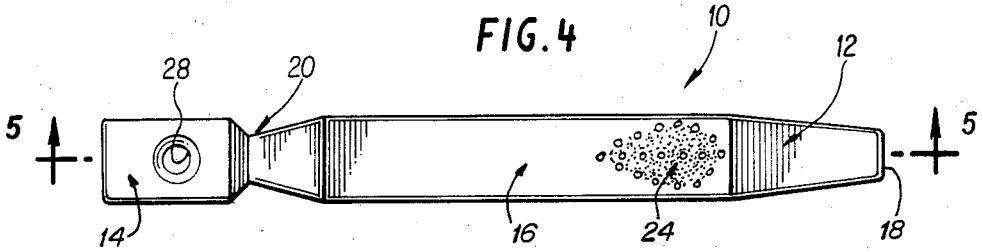
FIG. 4 is a plan view of the handbar.
Figure 5:
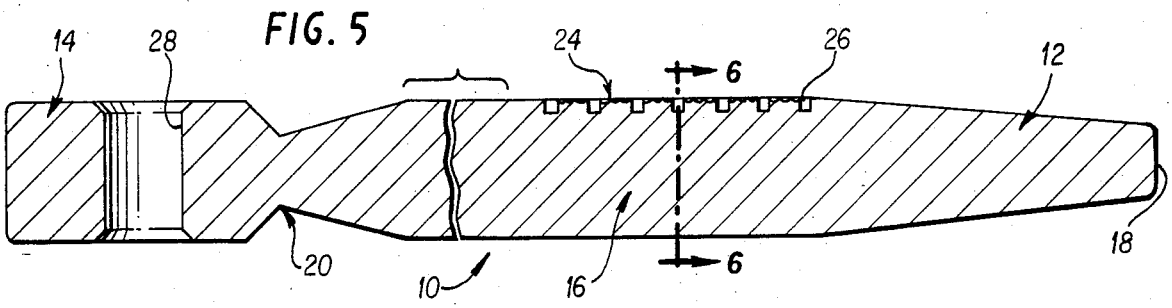
FIG. 5 is a sectional view of the handbar as seen along the line 5—5 in FIG. 4 on an enlarged scale.
Figure 6:
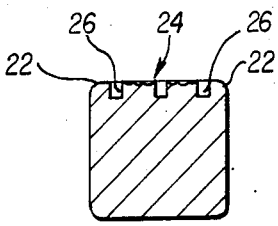
FIG. 6 is a sectional view of the handbar as seen along the line 6—6 in FIG. 5.

A hole 28 may extend through the second end 14 as illustrated in FIG. 2, and other Figures. The hole, while it may provide a function in the visual and tactile sense, principally provides the function of a convenient access for a thong (not shown) for hanging the handbar on a hook for storage, or in placing the handbar around the wrist during running or walking.

Figure 7:
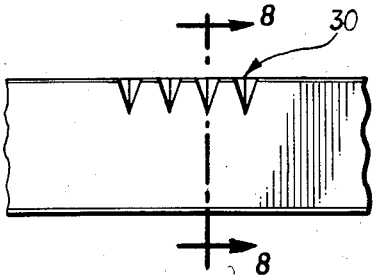
FIG. 7 is a partial view of a modified handbar including a plurality of notches along an edge.
Figure 8:
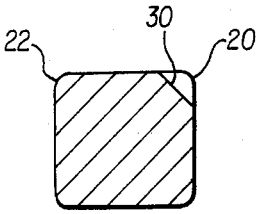
FIG. 8 is a sectional view as seen along the line 8—8 in FIG. 7.

Referring to FIGS. 7 and 8, a plurality of notches 30 may be located within the central region 16 of handbar 10. The notches, as illustrated in FIG. 8, may be located along an edge 22 for purposes of stimulation or a restimulation of alertness as the fingers of the hand are worked into and around the notches.

A handbar 10 of a preferred embodiment may be formed, as follows:

- length—$7\frac{3}{4}$ inch
- cross section—square with sides having a width of $\frac{3}{4}$ inch
- first end
  - length—1 9/16 inch
  - angle of taper—11°-12° to a blunt tip
  - width of tip—7/16 inch
- second end
  - length—$1\frac{3}{4}$ inch
  - width of blunt end—$\frac{3}{4}$ inch
- neck portion
  - length—$\frac{3}{4}$ inch
    - angle of taper—from first end to maximum constriction—about 26° to 27°
    - angle of taper—from second end to maximum constriction—about 68° to 69° (or about 62°, wherein the included angle is formed by the taper from second end and extension of the taper from first end)
- thumb placement area
  - distance from first end—3/16 inch
  - overall length—$1\frac{3}{4}$ inches
  - dimension of holes—1/16 inch
- securement hole—$\frac{3}{4}$ inch D.
  - chamfer—$\frac{1}{8}$ inch The handbar 10 may be formed of wood or some other material which is both solid and light in weight. The surfaces may be smooth, textured or smooth and textured according to the preference of the user. As illustrated in the Figures, and as may be clear from the criteria above, the handbar presents a plurality of discrete sides, the preferred embodiment of handbar includes four sides, and surfaces along the length of the handbar. These surfaces include the taper at the first end, the blunt tip, the central region, the neck portion, and so forth. Each of these sides and surfaces and the discrete edge therebetween may impart the visual and tactile stimulation as the fingers move into and along the various regions, all as previously discussed.

The handbar 10, in summary, is considered to discourage distraction of the runner and it helps to prevent injury or strain by an enhancement of concentration during running. The tactile sensation of the light weight structure, and unobtrusive design, by means of the massive innervation of the hand as represented on the cerebral cortex leads to controlled use of the hands and an enhanced sense of total body balance. The handbar of the invention is able to provide a prime function of improvement in hand movement which is considered to manifest itself in a prevention of injury and the harmful effects of overexertion. This is achieved by an increased balance, awareness and unstrained concentration.

We claim:

1. A handbar adapted to be held in the hand for use in exercise to stabilize hand movement through both visual and tactile stimulation to thereby increase balance and relaxation during exercise, said handbar comprising a body elongated in length and of overall substantially polygonal outline in sections perpendicular to the longitudinal axis of said body, said body having first and second dissimilar contoured ends, a central region between said ends of an outline substantially throughout its length both concentric and coextensive with the outline of one of said ends and discrete edges around said body and along its length which provide a tactile delineation of each side surface and said polygonal outline and regions along said length, a roughened area located within at least one side surface, said roughened area being located in a lengthwise off-center position and having an overall outline which substantially conforms to the size of a thumbprint, and wherein the side surfaces otherwise are overall substantially relatively smooth and continuous.

2. The handbar of claim 1 wherein said polygonal outline of said body is square.

3. The handbar of claim 1 wherein said body is easily portable and formed of a lightweight material.

4. The handbar of claim 1 wherein a first end of said body is tapered substantially uniformly toward a tip of an outline concentric with the outline of said body adjacent said taper, and the other end of said body is blunt.

5. The handbar of claim 4 wherein each said roughened area is disposed in said body adjacent said taper.

6. A handbar of claim 4 wherein said taper extends from said central region of said body, said handbar further including an indented length, said indented length being located along said body to connect said central region and said second end, and said indented length being formed by surfaces which taper toward and intersect at a location whereat the cross section is concentric and substantially coextensive with that of said tip.

7. The handbar of claim 1 wherein said discrete edges are rounded slightly to eliminate sharpness yet retain the sensation of tactile delineation between the sides.

8. The handbar of claim 1 wherein said first end is tapered substantially uniformly toward a tip of an outline concentric with the outline of said body adjacent said taper, and wherein said body includes a throughbore in said second end.

9. The handbar of claim 8 wherein said second end of said body is blunt.

10. The handbar of claim 1 including a plurality of notches formed along at least one of said discrete edges.

11. A handbar adapted to be held in the hand for use during exercise comprising a body having a first end region, a second end region, and a central region connecting said end regions, said body being elongated in length along an axis common to each region, said body, further, having an outer surface describing substantially a polygonal outline within each cross section along said axis and perpendicular to said axis between said ends, said second end region and said central region substantially throughout their lengths having concentric, coextensive outlines, and said first end region being tapered substantially uniformly along each surface from said central region toward a tip.

12. The handbar of claim 11 wherein said polygonal outline is square.

13. The handbar of claim 11 or 12 including an indented length, said indented length located within the area of junction of said second end region and central region, and formed by surfaces tapered substantially uniformly from one of said regions toward the other region.

14. The handbar of claim 11 or 12 including a roughened area located within said central region, near said first end region, and having substantially the shape of a teardrop.

15. The handbar of claim 14 including a roughened area located within said central region, near said end region, and having substantially the shape of a teardrop.

16. The handbar of claim 15 wherein the surfaces of said body intersect along a plurality of discrete edges, and including a plurality of notches formed within said central region along at least one edge.

* * * * *